United States Patent [19]

Baumann

[11] Patent Number: 4,545,161

[45] Date of Patent: Oct. 8, 1985

[54] GLAZED CURTAIN WALL CONSTRUCTION

[75] Inventor: Ubald A. Baumann, Wausau, Wis.

[73] Assignee: Marmet Corp., Wausau, Wis.

[21] Appl. No.: 591,679

[22] Filed: Mar. 21, 1984

[51] Int. Cl.[4] ..... E04H 1/00

[52] U.S. Cl. ..... 52/235; 52/464; 52/399; 52/732; 52/302; 49/DIG. 1

[58] Field of Search ..... 52/235, 461, 464, 509, 52/398, 399, 731, 732, 209, 302, 303, 272; 49/DIG. 1

[56] References Cited

U.S. PATENT DOCUMENTS

| | | | |
|---|---|---|---|
| 3,334,463 | 8/1967 | Muessel | 52/731 X |
| 4,021,987 | 5/1977 | Schnebel et al. | 52/731 X |

OTHER PUBLICATIONS

Marmet Corporation Drawing, Job Number K1047.

*Primary Examiner*—Donald G. Kelly
*Assistant Examiner*—Naoko N. Slack
*Attorney, Agent, or Firm*—Andrus, Sceales, Starke & Sawall

[57] ABSTRACT

A glazed curtain wall construction for a commercial building is composed of a multiplicity of glass window units and glass panel units which are supported in stacked relationship by a series of vertical columns or mullions. Each unit is rectangular in configuration being composed of a header, a sill and a pair of jambs that connect the header and sill together. The sill of each unit is provided with a downwardly projecting flange which is received within a groove in the header of the next lower unit and the header is provided with an inwardly extending flange that defines a downwardly facing recess which is supported on dumbbells attached to the side surfaces of adjacent mullions. In addition, one jamb of each unit is formed with a vertical flange which is received within a groove in the opposite jamb of the next adjacent unit. To install the unit, the flange on the sill is inserted into the groove in the header of the next lower unit, the unit is then slid sideways to engage the flange on the jamb with the groove in the jamb on the adjacent unit, and the recess on the header is then dropped over the dumbbells to support the header.

11 Claims, 4 Drawing Figures

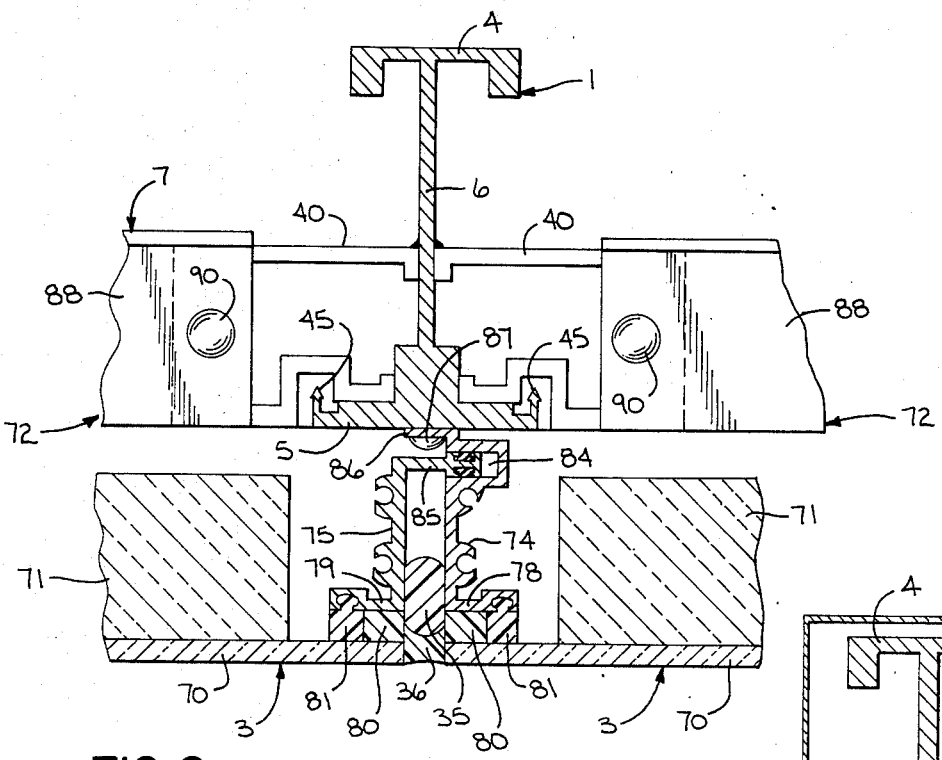
FIG. 2
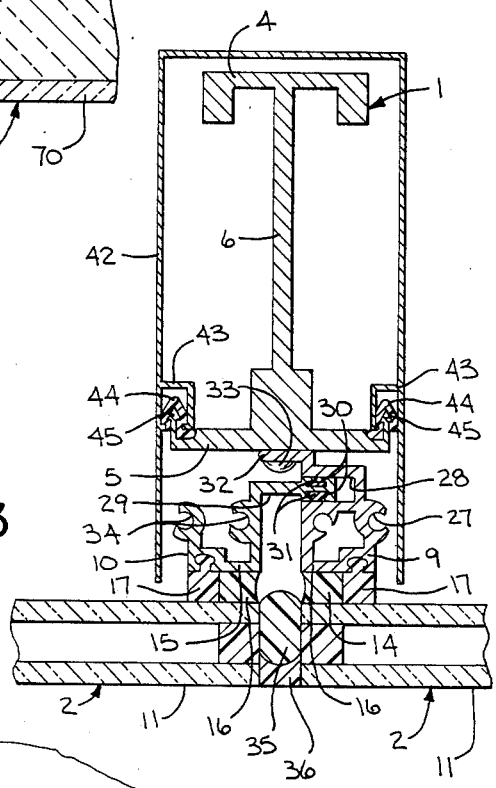
FIG. 3
FIG. 4
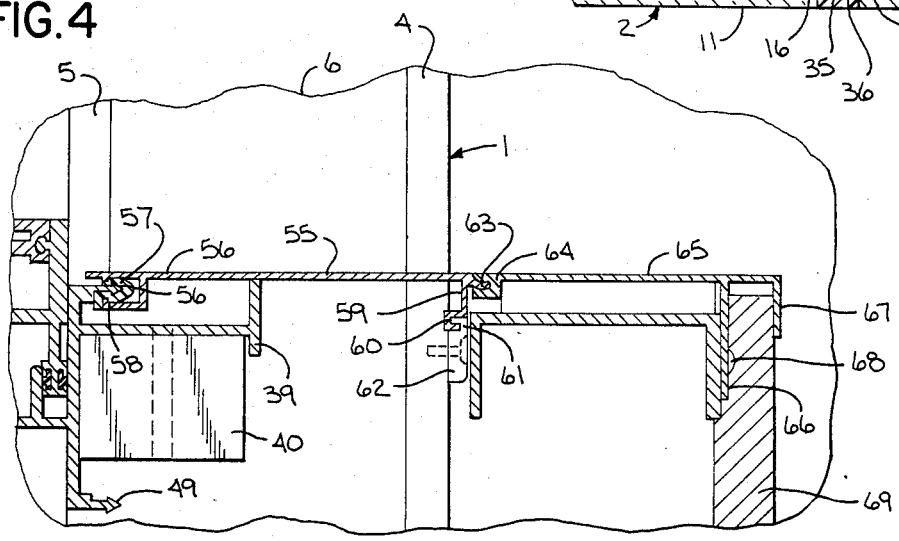

As illustrated in FIG. 3, the inner edge of each jamb 9 is formed with a flange 32 which is secured to the outer flange 5 of mullion 1 by screws 33.

The opposite jamb 10 is provided with a pair of vertical grooves or bosses 34, which are similar to bosses 29 in jamb 9, and serve to receive connecting screws for attachment of the header and sill to the jamb.

To seal the horizontal annd vertical joints between adjacent windows 11, a foam plastic backing strip 35 is positioned in the joint between the windows, along with a strip of caulking or sealant 36.

As shown in FIG. 1, each header 7 is provided with an inward extension 37 including a generally horizontal surface 38 and a downwardly extending lip 39 located at the inner edge of surface 38. The ends of horizontal surface 38 are adapted to rest on abutments or dumbbells 40, which are welded to the side surfaces of mullion 1 and the surface 38 is secured to the dumbbells 40 by screws 41.

The window units 2 are pre-assembled including the glazing. To install the window units, the downwardly extending flange 18 is inserted within the groove 19 of the header 7 of the next lower unit. The window unit is then slid sideways causing the flange 29 on jamb 10 to be received within groove 28 in jamb 9 of the next adjacent window unit. Horizontal surface 38 of the header 7 is then dropped downwardly to engage the dumbbells 40. The window is thus secured by virtue of the tongue and groove connection along the sill and the tongue and groove connection along one jamb and the engagement of the header with the dumbbells. To complete the installation, screws 41 are installed, locking the header 7 to the dumbbells 40, and screws 33 are installed securing the jamb 9 to the outer face 5 of mullion 1.

As best shown in FIG. 3, U-shaped trim 42 can be applied over the vertical mullions 1. Trim 42 is provided with a pair of internal side channels 43 and plastic clips 44 are mounted within each side channel 43. The ends of outer flange 5 of mullion 1 are provided with pointed, inwardly facing ribs 45 which are snap-fitted to the clips 44 to retain the trim 42 in position.

It is also contemplated that ceiling trim can be employed to enclose the space between the suspended ceiling of the building and the window unit. As shown in FIG. 1, the ceiling trim 46 is formed with a channel 47 and plastic clips 48 are mounted within channel 47 and receive the pointed ribs 49 formed on header 7.

The inner portion of ceiling trim 46 is provided with a horizontal extending drapery recess 50.

To connect the inner portion of trim 46 to the mullions 1, a tang 51 is received within a groove in a retaining clip 52 secured to the inner flange 4 of mullion 1. The inner end of drapery recess 50 is defined by a flange 53 which extends downwardly to a location substantially flush with the suspended ceiling 54.

In addition to the ceiling trim, sill trim can also be utilized. In this regard, the sill trim 55, as best shown in FIG. 4, is provided with a horizontal channel 56 and plastic clips 57 are mounted within channel 56 and engage inwardly extending pointed ribs 58 formed on the header 7. The inner end of trim strip 55 is constructed with a downwardly extending flange 59 formed with a groove 60 that receives a tang 61 on retaining clip 62 secured to the inner flange 4 of mullion 1.

In addition, the inner edge of trim strip 55 is formed with a generally curved lip 63 which is received within a curved slot 64 formed in the outer end of trim strip 65. The inner end of trim strip 65 is formed with a pair of parallel flanges 66 and 67. Flange 66 is secured by screw 68 to the studs, or other structural members, while the flange 67 extends downwardly on the outer surface of the drywall 69 or plasterboard.

With this construction, the ceiling trim 46 and the sill trim 55 and 65 are installed without the use of any exposed screws or fasteners.

Glazed panel units 3 are installed to the mullions 1 in a manner similar to that described with respect to the window units 2. Each panel unit 3 includes an outer pane of glass 70 and a layer of foam or fibrous insulating material 71 is bonded to the inner surface of glass panel 70.

The glass panel units 3 are rectangular in shape being composed of an upper header 72, a lower sill 73, and a pair of jambs 74 and 75 which connect the header and sill together.

The header 72, sill 73, and jambs 74 and 75 of the panel units 3 have basically the same configuration as the window units 2.

The glass panel 70 is secured to the outer surfaces of flanges 76, 77, 78 and 79 of the header 72, sill 73, and jambs 74 and 75, respectively, by a layer of structural adhesive 80. In addition, a resilient spacer strip 81 is interposed between glass panel 70 and the respective flanges 76–79.

As in the case of the window units 2, each header 72 is provided with an upwardly facing groove 82 which receives a downwardly extending flange 83 on the sill 73 of the next upper unit. In addition, each jamb 74 is provided with a vertical groove 84 which receives a flange 85 on jamb 75 of the next adjacent panel or window unit. Jamb 74 is also formed with a side flange 86 which is attached to the forward surface 5 of the mullion 1 by screws 87, as shown in FIG. 2.

As described with respect to each window unit 2, the header 72 of each panel unit 3 is formed with an inwardly extending flange or extension 88, as illustrated in FIG. 1, which defines a downwardly facing recess 89 that rests on the dumbbells 40 to support the upper end of the panel unit 3. Screws 90 connects the extension 88 to the respective dumbbells 40.

To support the lower edge of the glass panel 70, a series of generally Z-shaped support brackets 91 are secured to the sill 73, as shown in FIG. 1, and each bracket 91 is formed with an outwardly extending leg 92 which supports the panel 70. A support pad 93 is interposed between leg 92 and the lower edge of panel 70.

The backing strip 35 and sealant 36 can be applied to the joints between adjacent edges of panel units, or to the joints between adjacent window units and panel units, to seal the same.

The upstanding flange 94 on header 7 and header 72 provides a trough 95 which prevents any water which may have leaked into the curtain wall construction from draining to the interior of the building. Fibrous wicks 96 are positioned at the junction between horizontal and vertical joints between adjacent units, as shown in FIG. 1, and any liquid which may have accumulated within the trough 95 will be conducted to the exterior through the capilliary action of wicks 96.

The curtain wall construction of the invention substantially reduces the labor cost in installation of the glazed window and panel units. As the units are all installed from the interior of the building, it eliminates the necessity of expensive exterior scaffolding.

GLAZED CURTAIN WALL CONSTRUCTION

BACKGROUND OF THE INVENTION

Glazed curtain wall constructions are formed of modular glazed window units and panel units which are normally pre-assembled and installed to structural members at the installation site.

With certain curtain wall constructions, the window and panel units must be installed from the exterior of the building and this requires extensive scaffolding, particularly, if the building is of substantial height.

In the typical curtain wall construction, both jambs, the header, and the sill of the window and panel units are normally mounted to structural members or adjacent units by screws or other fasteners, the installation of fasteners is a time consuming operation that is a substantial factor in the overall cost of the construction.

SUMMARY OF THE INVENTION

The invention is directed to an improved glazed curtain wall construction which can be readily installed from the interior of the building with a minimum use of auxiliary fasteners. In accordance with the invention, the glazed curtain wall construction is composed of a series of pre-assembled glazed window and panel units which are supported in stacked relation between spaced vertical columns or mullions.

The window and panel units are rectangular in shape and are composed of a header, a sill and a pair of jambs which connect the header and sill. The sill of each unit is provided with a downwardly extending lip or flange, while the header is provided with an upwardly facing groove. Similarly, one jamb of each unit is formed with a flange, while the opposite jamb is provided with a groove.

In addition, the header of each unit has an inwardly extending flange or extension which defines a downwardly facing recess, the ends of which are supported on abutments or dumbbells attached to the side surfaces of the respective mullions.

To install the unit, the flange on the sill is inserted within the groove in the header of the next lower unit and the unit is then slid sideways to engage the flange on the jamb with the groove in the jamb of the next adjacent unit. The recess in the header is then dropped down onto the dumbbells to directly support the header from the mullions.

Following this, the header is secured by fasteners to the dumbbells and the jamb having the groove is secured by fasteners to the forward face of the mullion to complete the assembly.

As a further feature of the invention, snapon trim can be used to enclosed the mullions, as well as to provide a window sill and a ceiling extension and the trim is designed so that there are no exposed fasteners.

The glazed curtain wall construction of the invention enables the window and panel units to be installed from the interior of the building, thereby eliminating the necessity of exterior scaffolding. As the window and panel units are pre-glazed, it eliminates the requirement for glazers on the job.

The installation of the window and panel units requires the use of screws only along one jamb and for the attachment of the header to the dumbbells. This substantially reduces the necessary labor for installation.

The glass windows and panels are secured to the pre-assembled units by structural adhesive so that there are no metal stops or retainers projecting outwardly from the windows or panels. This provides a more attractive appearance for the curtain wall construction.

Other objects and advantages will appear in the course of the following description.

DESCRIPTION OF THE DRAWINGS

The drawings illustrate the best mode presently contemplated of carrying out the invention.

In the drawings:

FIG. 2 is a section taken along line 2—2 of FIG. 1;

FIG. 3 is a section taken along line 3—3 of FIG. 1; and

FIG. 4 is a vertical section showing the attachment of window sill trim.

DESCRIPTION OF THE ILLUSTRATED EMBODIMENT

Figure 1:
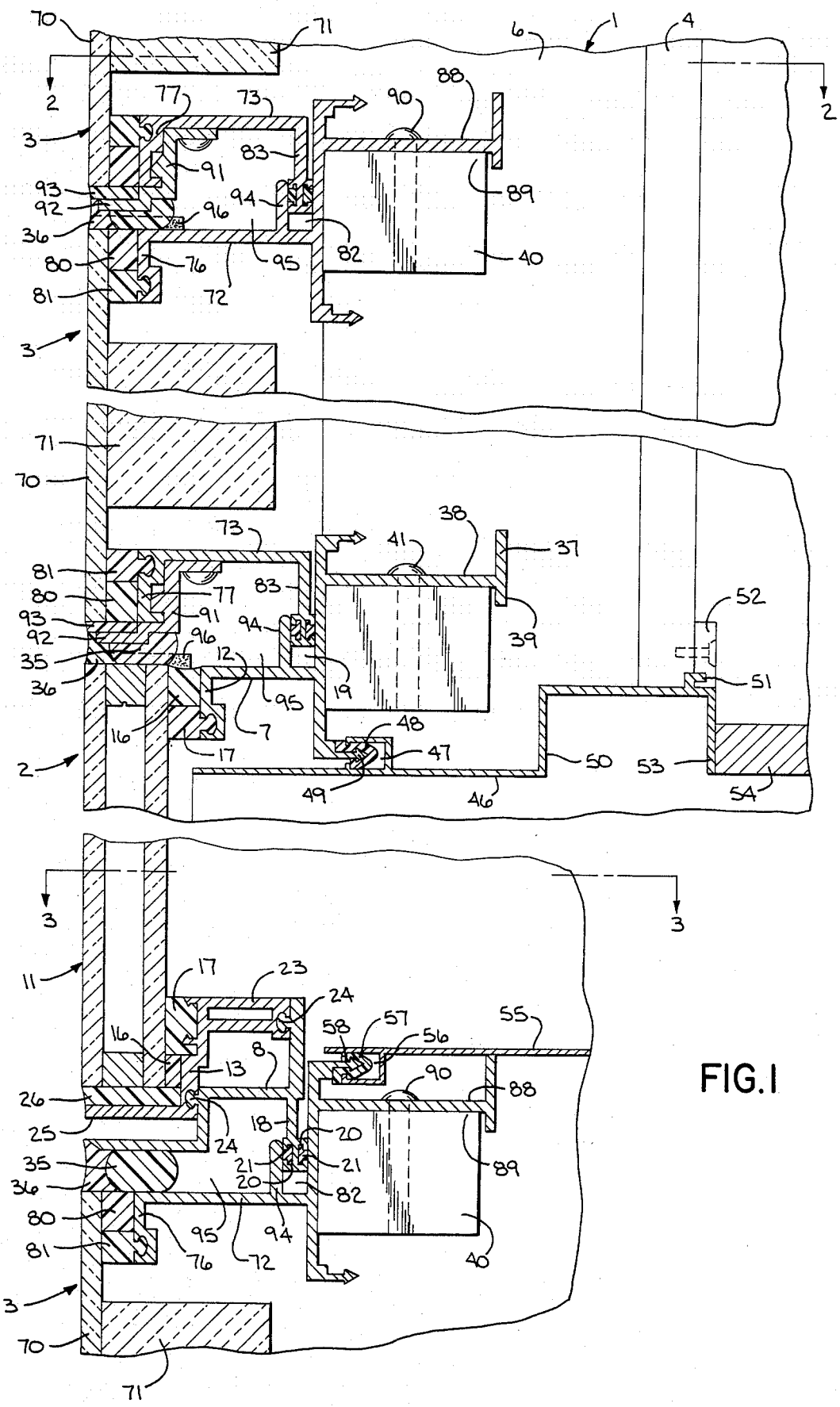
FIG. 1 is a vertical section of the curtain wall construction of the invention.

The drawings show a glazed curtain wall construction for a building which includes a series of spaced, generally I-shaped vertical mullions or columns 1 which support a plurality of glazed window units 2 and glazed panel units 3. As shown in FIGS. 2 and 3, each mullion 1 is provided with an inner flange 4, an outer flange 5, and a connecting web 6.

The window units 2 are each composed of a header 7, a sill 8, and a pair of jambs 9 and 10 which connects the header and sill together. The header 7, sill 8, jambs 9 and 10, are preferably aluminum extrusions.

A double-glazed window 11 is secured to the flanges 12, 13, 14, and 15 of the header 7, sill 8, and jambs 9 and 10, respectively, by a layer of structural adhesive 16, such as silicone cement. In addition, spacers 17 are located between the respective flanges and the window 11.

Each sill 8 is formed with a downwardly extending flange 18, as shown in FIG. 1, which is received within an upwardly facing groove 19 in header 7 of the next lower window or panel unit. The lower edge of flange 18 has a pair of opposed recesses 20 and rubber-like pads 21, formed of neoprene, or the like, are disposed within recesses 20 to prevent metal-to-metal contact between the flange 18 and walls bordering groove 19. The pads 21 serve as silencers and eliminate noise due to thermal expansion of the window and panel units.

Sill 8 also includes a bracket 23 which is connected to the sill through tongue and groove connections indicated by 24. Bracket 23 is formed with an outwardly extending horizontal flange 25 which serves to support the window 11, and a resilient pad 26 is interposed between flannge 25 and the lower edge of window 11.

As shown in FIG. 3, the jamb 9 of window unit 2 has a vertically extending groove or boss 27, the ends of which receive screws to attach the header and sill respectively, to the jamb. In addition, jamb 9 is provided with a groove 28 which receives an outwardly extending flange 29 formed on jamb 10 of the next adjacent window unit, as illustrated in FIG. 3. Flange 29 is constructed with a pair of opposed recesses 30 and pads 31 are positioned in recesses 30 to prevent metal-to-metal contact between the flange 29 and the walls bordering recess 30. Pads 31 act as silencers, in a manner similar to pads 21, to eliminate expansion noise.

Furthermore, the tongue and groove connection between the header and adjacent sill and between the jambs minimizes the need for conventional fasteners or screws and this also provides a substantial reduction in the labor cost of installation.

Various modes of carrying out the invention are contemplated as being within the scope of the following claims particularly pointing out and distinctly claiming the subject matter which is regarded as the invention.

I claim:

1. A curtain wall construction for a building, comprising a plurality of spaced vertical supports, a plurality of generally rectangular exterior units supported by the vertical supports and located outwardly of said vertical supports, each unit being rectangular in shape and including an upper horizontal member, a lower horizontal member; and a pair of vertical jambs connecting the upper horizontal member and lower horizontal member, said units being disposed in stacked and side-by-side relation in said curtain wall, one of said horizontal members having a vertically extending groove and the other of said horizontal members having a vertical flange disposed in said groove to provide a first tongue and groove connection between the lower horizontal member of one unit and the upper horizontal member of an adjacent unit, and abutment means formed on the sides of said vertical supports the upper horizontal member of each unit having a downwardly facing recess engaged with said abutment means to support the upper horizontal member from said vertical supports, a first of jambs having a vertically extending groove and the second of said jambs having a vertically extending flange, the flange on said second jamb being disposed in the groove in the first jamb of the next adjacent unit to provide a second tongue and groove connection between the jambs of said adjacent units.

2. The construction of claim 1, wherein each unit includes an outer glass panel.

3. The construction of claim 2, wherein said glass panel is a window.

4. The construction of claim 1, wherein said upper horizontal member is provided with an inwardly extending extension, said recess being formed in said extension.

5. The construction of claim 1, wherein one jamb of each unit is attached directly to the outer surface of said vertical support.

6. The construction of claim 5, wherein said first jamb has a lip extending substantially the full length of said first jamb, said lip being secured to the outer surface of said vertical support.

7. A curtain wall construction for a building, comprising a plurality of spaced vertical supports, a plurality of generally rectangular exterior units supported by the vertical support and located outwardly of said vertical support, each unit being rectangular in shape and including an upper horizontal member, a lower horizontal member, and a pair of vertical jambs connecting the header and lower horizontal member, said units being disposed in stacked and side-by-side relation in said curtain wall, one of said horizontal members having a vertically extending groove and the other of said horizontal members having a vertical flange disposed in said groove to provide a first tongue and groove connection between the lower horizontal member of one unit and the upper horizontal member of an adjacent unit, an abutment disposed on adjacent vertical supports with said abutments facing each other, an extension extending inwardly from the upper horizontal member and including a generally flat surface resting on said abutments, said extension also including a downwardly extending lip disposed inwardly of said abutments, a first of said jambs having a vertically extending groove and the second of said jambs having a vertically extending flange, the flange on said second jamb being disposed in the groove in the first jamb of the next adjacent unit to provide a second tongue and groove connection between the jambs of said adjacent units.

8. The construction of claim 7, wherein the horizontal length of said extension is less than the distance between adjacent vertical supports to permit the unit to slide horizontally.

9. The construction of claim 7, wherein said upper horizontal member is provided with a trough disposed outwardly of said first tongue and groove connection, and wick means connecting the trough with the exterior to permit drainage of moisture from the trough to the exterior by capilliary action.

10. The construction of claim 7, wherein said horizontal members and said jambs have outer surfaces, said unit including a sheet of glass bonded to said outer surfaces with the outer surface of said glass being free of external stops.

11. The construction of claim 7, and including a strip of ceiling trim secured to the upper horizontal member and to said vertical supports said ceiling trim strip extending inwardly from the unit and having an upwardly extending recess defining a drapery pocket.

* * * * *

UNITED STATES PATENT AND TRADEMARK OFFICE

CERTIFICATE OF CORRECTION

PATENT NO. : 4,545,161

DATED : October 8, 1985

INVENTOR(S) : UBALD A. BAUMANN

It is certified that error appears in the above-identified patent and that said Letters Patent is hereby corrected as shown below:

Col. 2, line 55, Cancel "flannge" and substitute therefor ---flange---; Col. 3, line 8, Cancel "annd" and substitute therefor ---and---; Col. 3, line 22, After "flange 18" insert ---on sill 8---; Col. 3, line 49, Cancel "horizontal" and substitute therefor ---horizontally---; Col. 5, line 28, CLAIM 1, After "supports" insert ---,--- (comma); Col. 6, line 6, CLAIM 7, Cancel "support" and substitute therefor ---supports---; Col. 6, line 7, CLAIM 7, Cancel "support" and substitute therefor ---supports---; Col. 6, line 10, CLAIM 7, Cancel "header" and substitute therefor ---upper horizontal member---; Col. 6, line 47, After "supports" insert ---,--- (comma).

Signed and Sealed this

*Eighteenth* Day of *March 1986*

[SEAL]

*Attest:*

DONALD J. QUIGG

*Attesting Officer*

*Commissioner of Patents and Trademarks*